United States Patent [19]

Bischofberger et al.

[11] Patent Number: 5,029,366

[45] Date of Patent: Jul. 9, 1991

[54] COMBING MACHINE WITH SUCTION REMOVAL

[75] Inventors: Jürg Bischofberger, Elsau-Räterschen; Andreas Jörg, Neftenbach; Giancarlo Mondini; Peter Oehy, both of Winterthur, all of Switzerland

[73] Assignee: Rieter Machine Works Ltd., Winterthur, Switzerland

[21] Appl. No.: 438,177

[22] Filed: Nov. 20, 1989

[30] Foreign Application Priority Data

Nov. 23, 1988 [CH] Switzerland ..... 04356/88

[51] Int. Cl.[5] ..... D01G 19/28

[52] U.S. Cl. ..... 19/225

[58] Field of Search ..... 19/221-235

[56] References Cited

U.S. PATENT DOCUMENTS

| | | | |
|---|---|---|---|
| 1,605,135 | 11/1926 | Nasmith . | |
| 1,713,959 | 5/1929 | Gegauf | 19/227 |
| 1,714,017 | 5/1929 | Gegauf | 19/227 |
| 2,663,053 | 12/1953 | Schleifer | 19/227 |

FOREIGN PATENT DOCUMENTS

| | | | |
|---|---|---|---|
| 664202 | 9/1965 | Belgium . | |
| 2139305 | 2/1973 | Fed. Rep. of Germany . | |
| 2264899 | 3/1974 | France | 19/230 |
| 7508807 | 10/1975 | France . | |
| 475379 | 8/1969 | Switzerland . | |
| 11392 | 9/1885 | United Kingdom | 19/229 |
| 334194 | 8/1930 | United Kingdom | 19/229 |

*Primary Examiner*—Werner H. Schroeder
*Assistant Examiner*—John J. Calvert
*Attorney, Agent, or Firm*—Sandler, Greenblum & Bernstein

[57] ABSTRACT

The combing machine comprises a continuously rotatable circular-comb cylinder carrying a circular-comb segment and a detaching segment. The detaching segment cooperates with a detaching pressure roll. The combing machine also contains a nipper unit comprising a lower nipper which is stationary relative to the axis of the continuously rotatable circular-comb cylinder, and an upper nipper which is movable relative to the lower nipper. The fibers detached by the detaching segment together with the detaching pressure roll are sucked as fiber clusters into a suction shaft or tube, or can be united to form a sliver at a rotatable screening or sieve drum. The combing machine is of simple construction and economical to manufacture and renders possible a high operating speed and, therefore, a higher output, particularly in the absence of a top comb between the lower nipper and the detaching pressure roll.

21 Claims, 3 Drawing Sheets

COMBING MACHINE WITH SUCTION REMOVAL

CROSS-REFERENCE TO RELATED PATENT APPLICATION

This application is related to the commonly assigned, copending U.S. Pat. application Ser. No. 07/409,365, filed Sept. 19, 1989, entitled "COMBING MACHINE".

BACKGROUND OF THE INVENTION

The present invention relates to a new and improved construction of combing machine comprising a continuously rotatable cylinder or roll which carries at least one circular-comb segment and at least one detaching segment which cooperates with a detaching pressure roll or roller. The combing machine also contains a nipper unit comprising a lower or bottom nipper which is stationary relative to the axis of the continuously rotatable cylinder or roll, and an upper or top nipper which is movable relative to the lower or bottom nipper.

A combing machine having the aforementioned components and constructional details was proposed by Heilmann as early as 1845.

SUMMARY OF THE INVENTION

Therefore, with the foregoing in mind it is a primary object of the present invention to provide a new and improved construction of a combing machine of the aforementioned type which is simple in construction and design and can be economically manufactured.

Another and more specific object of the present invention aims at providing a new and improved construction of a combing machine by means of which a substantially higher production rate, i.e. fiber quantity per unit of time, is rendered possible in comparison with the productivity of prior art combing machines.

Yet a further significant object of the present invention aims at providing a new and improved construction of comber or combing machine which reduces cost of fabrication, increases productivity in terms of combed-out fibers per unit of time and yet affords highly reliable operation thereof, without being subject to breakdown or malfunction.

Now in order to implement these and still further objects of the present invention, which will become more readily apparent as the description proceeds, the combing machine of the present invention is manifested, among other things, by the features that suction means are provided for intaking or conveying by suction the fibers detached by the detaching segment and the detaching pressure roll or roller.

The suction means render possible dispensing with the separate or individual detaching roll or roller provided in hitherto known combing machines, and with the conventional detaching pressure roll or roller which cooperates with the separate or individual detaching roll or roller and is rotated in pilgrim-step manner.

In its simplest form the suction means can comprise a suction shaft or tube having an intake port or opening adjacent to the detaching pressure roll or roller which cooperates with the at least one detaching segment. However, with a suction shaft or tube there are obtained individual fiber clusters and not a combed sliver. In other words, the combing machine practically operates as a staple sorting or grading machine.

On the other hand, the fiber suction means can constitute a screening or sieve drum, the inner chamber or space of the latter being connectable to a source of negative pressure or underpressure or vacuum. Such screening or sieve drum renders possible the production of a combed-out sliver.

A further constructional simplification and a considerable increase in productivity or output are rendered possible if the top comb used in known combers or combing machines is dispensed with, i.e. if there is provided a free space without additional combing elements between the lower or bottom nipper and the detaching pressure roll or roller when the nipper unit is in its open or front end position. Dispensing with the use of a top comb would mean having to put up with a reduction or decrease in combing quality. Such decrease in combing quality can be held within limits if the nipper unit is provided with an additional nipper which is movable relative to the lower or bottom nipper, in order to clamp thereat a lap fed thereto during the detachment of fibers from such lap. Instead of providing such an additional nipper, the nipper unit can also advantageously comprise a rotatable lap-pressing cylinder or roll for pressing against the lower or bottom nipper a lap to be combed.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
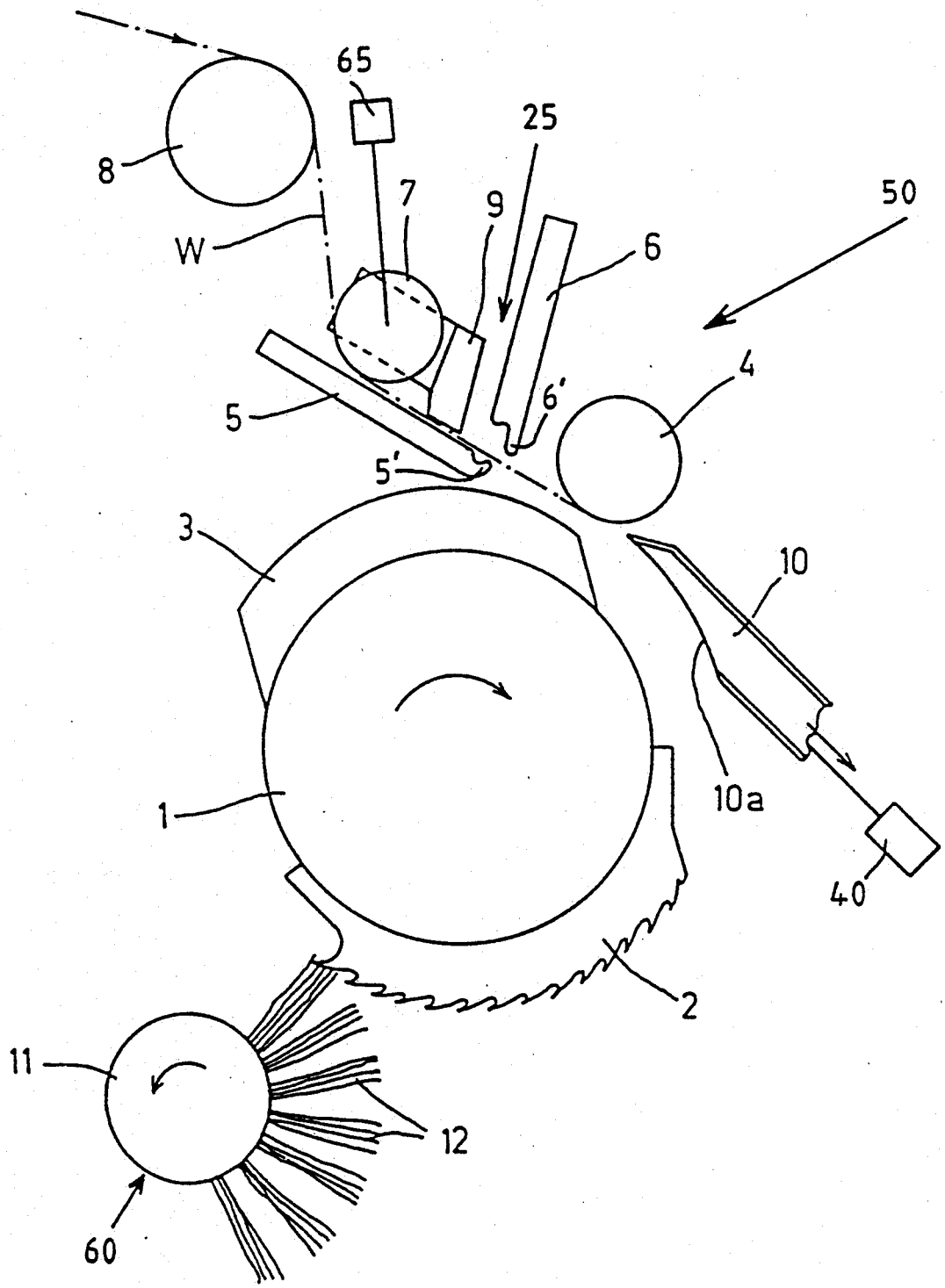
FIG. 1 schematically shows in a substantially vertical sectional side view the main or essential parts or components of a combing machine constructed according to the invention.

Describing now the drawings, it is to be understood that to simplify the showing thereof, only enough of the combing machine has been illustrated therein as is needed to enable one skilled in the art to readily understand the underlying principles and concepts of the present invention. Turning attention now specifically to FIG. 1 of the drawings, a combing machine 50 schematically shown therein by way of example and not limitation will be seen to comprise a continuously rotatable circular-comb cylinder or roll 1 provided with a circular-comb segment 2 and a detaching segment 3, the latter cooperating with a detaching pressure roll or roller 4. The continuously rotatable circular-comb cylinder or roll 1 could be provided with a number of circular-comb segments 2 as well as a number of detaching segments 3.

The combing machine 50 also comprises a nipper unit 25 having a lower or bottom nipper 5 which is stationary relative to the axis of the rotatable circular-comb cylinder or roll 1, and an upper or top nipper 6. The latter is movable relative to the lower or bottom nipper 5, in order to clamp between a front edge 5' of the lower or bottom nipper 5 and a bottom edge 6' of the upper or top nipper 6 a fiber tuft which is then combed out by the circular-comb segment 2 passing beneath the lower or bottom nipper 5.

An intermittently rotatable feed cylinder or roll 7 is suitably mounted in lateral or side arms of the lower or bottom nipper 5 which are not particularly illustrated in the drawings. From a delivery or supply roll 8 there is fed to the intermittently rotatable feed cylinder or roll 7 a lap W which is to be combed. Furthermore, there is arranged in the nipper unit 25 a suitable lap-pressing element or member which serves to press the lap W against the lower or bottom nipper 5 at a location between the intermittently rotatable feed cylinder or roll 7 and the front edge 5' of the lower or bottom nipper 5.

In the exemplary embodiment of the nipper unit 25 depicted in FIG. 1 the lap-pressing element or member constitutes an additional nipper 9 which is advantageously pivotable, for example, about the axis of the intermittently rotatable feed cylinder or roll 7 appropriately driven by drive or drive means 65. Likewise forming part of the inventive combing machine 50 are a cleaning brush 60 comprising a brush roll or roller 11, and a suction shaft or tube 10 connected to a merely schematically illustrated vacuum or negative pressure source 40. The suction shaft or tube 10 possesses an intake port or opening 10*a* which is adjacent to the detaching pressure roll or roller 4. It can be convenient to provide only a part or portion of the circumference of the brush roll or roller 11 of the cleaning brush 60 with a brush segment 12 such that the latter cooperates solely with the circular-comb segment 2 and, accordingly, does not damage the detaching segment 3. It is here noted that the drive or drive means 65 can selectively rotate the intermittently rotatable feed cylinder or roll 7 prior to, subsequent to or both prior and subsequent to the detachment of fibers from the lap fed to the lower nipper 5.

Having now had the benefit of the foregoing discussion of the exemplary embodiment of the combing machine 50 depicted in FIG. 1, its mode of operation will now be described and is as follows:

As mentioned hereinbefore, the nipper unit 25 is closed when the circular-comb segment 2 passes beneath the front edge 5' of the lower or bottom nipper 5. The nipper unit 25 in this closed or rear end position presents to the circular-comb segment 2 a fiber tuft from the infed lap W.

The nipper unit 25 then opens after the circular-comb segment 2 has left this fiber tuft. The intermittently rotatable feed cylinder or roll 7 can now advance, by an adjustable amount, the lap W at the lower or bottom nipper 5. The additional nipper 9 is then lowered toward the lower or bottom nipper 5, as depicted in FIG. 1, in order to retain the lap W clamped against the lower or bottom nipper 5 during the following detaching operation. The lap clamping location at the lower or bottom nipper 5 is slightly behind or at the rear of the front edge 5' of the latter.

During further rotation of the circular-comb cylinder or roll 1, the fiber tuft then comes to lie, more or less in the depicted position of the circular-comb cylinder or roll 1, upon the arriving detaching segment 3, is then raised by the latter and clamped against the detaching pressure roll or roller 4. As the detaching segment 3 continues to move, the fibers clamped between the detaching segment 3 and the detaching pressure roll or roller 4 are then detached. The detached fibers are sucked into the suction means here shown as the suction shaft or tube 10. The detaching pressure roll or roller 4 can be rotated either by the rotary movement of the detaching segment 3 or by a suitable individual drive or drive means.

After detachment of the fibers the additional nipper 9 is lifted away from the lower or bottom nipper 5. The intermittently rotatable feed cylinder or roll 7 can then again advance, by an adjustable amount, the lap W at the lower or bottom nipper 5. This second lap advance or feed movement is optional if the lap W has been advanced already prior to the detaching operation.

Before the circular-comb segment 2 reappears beneath the lower or bottom nipper 5, the nipper unit 25 is closed, whereafter the combing cycle recommences.

The fibers extracted or removed by suction through the shaft or tube 10 are in the form of fiber clusters which by virtue of the combing-out operation have been freed from or rid of impurities, contamination and short fibers. The combing machine 50 actually operates as a staple sorting or grading machine. The fiber clusters obtained can be re-transformed into a sliver, for example, by means of a card or carding machine.

The combing machine 50 is simple in construction and design and has relatively few moving parts or components. Accordingly, the combing machine 50 is not only economical to manufacture and therefore relatively inexpensive, but also can operate at high working speeds. Furthermore, a high output or productivity is also rendered possible in that, when the upper or top nipper 6 is lifted away from the lower or bottom nipper 5, there is provided a free space without additional combing elements, i.e. without the otherwise customary top comb, between the front edge 5' of the lower or bottom nipper 5 and the detaching pressure roll or roller 4. In this manner, a thicker lap W can be supplied to the combing machine 50.

In FIGS. 2 to 6 there are depicted different possible variants or exemplary embodiments of the combing machine 50 constructed according to the invention. Throughout these FIGS. 2 to 6 there have been generally used the same reference characters to denote the same or analogous components as in FIG. 1.

Figure 2:
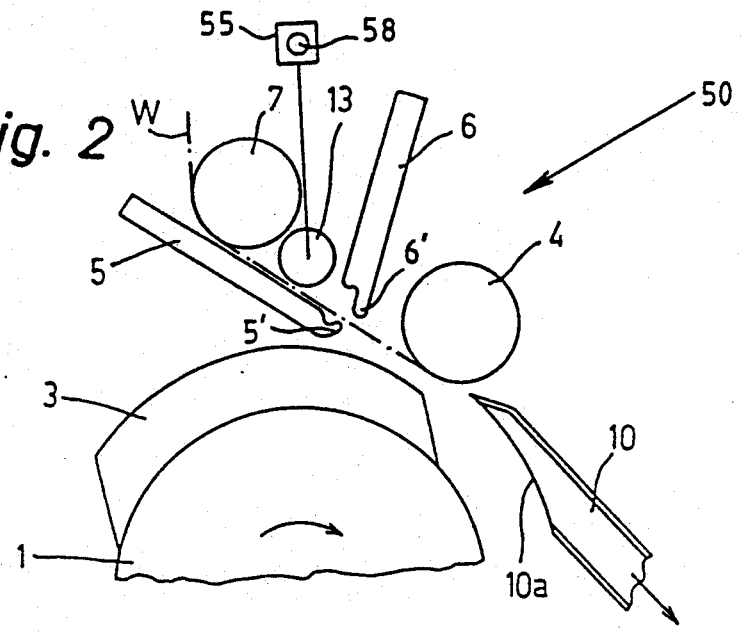
FIG. 2 shows a fragmentary side view, partially in section, of a first variant of a part of the combing machine depicted in FIG. 1.

In the first variant according to FIG. 2 the additional nipper 9 depicted in FIG. 1 has been omitted and replaced by a relatively small rotatable lap-pressing cylinder or roll 13 which is appropriately mounted at the lower or bottom nipper 5 and located as close as possible to the front edge 5' of the latter. This lap-pressing cylinder or roll 13, which continuously presses the lap W to be combed against the lower or bottom nipper 5, is driven each time, when the intermittently rotatable feed cylinder or roll 7 is rotated, by a suitable schematically illustrated drive or drive means 55 comprising a free wheel device 58.

Figure 3:
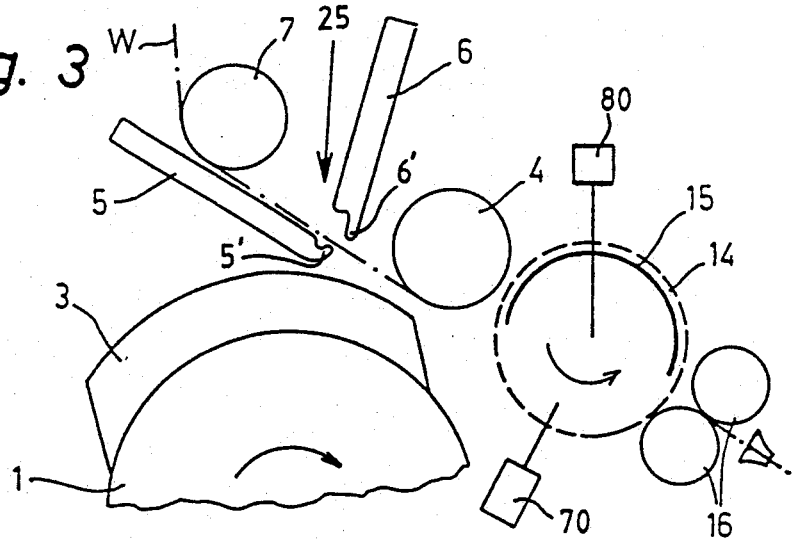
FIG. 3 shows a fragmentary side view, partially in section, of a second variant of a part of the combing machine depicted in FIG. 1.

In the second variant according to FIG. 3 the suction shaft or tube 10 depicted in FIG. 1 is omitted and replaced by a rotatable screening or sieve drum 14 which is adjacent to the detaching pressure roll or roller 4 and which sucks in, i.e. conveys by suction the fibers detached by the detaching segment 3 and the detaching pressure roll or roller 4. This rotatable screening or sieve drum 14, the interior or interior space thereof being connected to a merely schematically illustrated vacuum or negative pressure source 70, possesses an air-pervious shell or jacket which is internally covered in an upper zone of its circumference by a stationary air-impervious shielding or shielding member 15. Consequently, the vacuum or negative pressure or underpressure is effective only in a lower zone of the shell circumference at which the extracted fibers are conveyed by the rotation of the screening or sieve drum 14 to a pair of pressure rollers 16 arranged downstream of the latter. The screening or sieve drum 14 is rotated by suitable and thus merely schematically shown drive means 80 either continuously, or by steps, or with a pilgrim step motion. If it is ensured by appropriate drive means that the fiber clusters, which are consecutively detached by the detaching segment 3 and the detaching pressure roll or roller 4, overlap to some extent at the screening or sieve drum 14, the combing machine variant depicted in FIG. 3 together with the pair of pressure rollers 16 renders possible that a sliver is directly obtained. However, it is also possible to individually or separately transport the fiber clusters at the screening or sieve drum 14 and to unite such fiber clusters to form a sliver only at the pair of pressure rollers 16, the latter being rotated with a pilgrim step motion.

Figure 4:
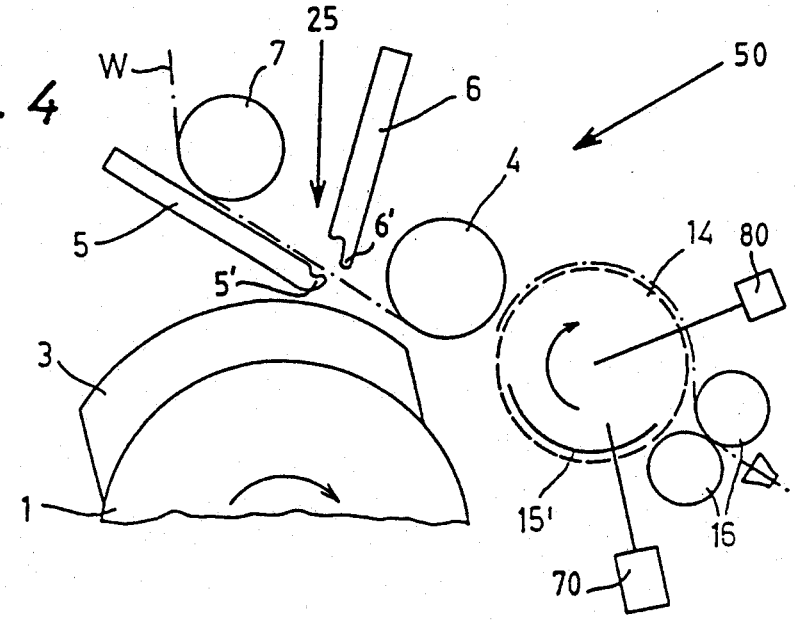
FIG. 4 shows a fragmentary side view, partially in section, of a third variant of a part of the combing machine depicted in FIG. 1.

The third variant according to FIG. 4 differs from the variant according to FIG. 3 only in that the screening or sieve drum 14 rotates in the opposite direction and that a stationary air-impervious shielding or shielding member 15' covers the air-pervious shell or jacket of the screening or sieve drum 14 internally in a lower zone or region of its circumference. The vacuum or negative pressure or underpressure provided by the vacuum source 70 is therefore effective only in an upper zone or region of the circumference of the screening or sieve drum 14 and the sucked-in, i.e. suction convey fibers are conveyed at this upper zone of the drum circumference to the pair of pressure rollers 16. In other respects, the operation is the same as for the second variant according to FIG. 3.

To simplify the illustration no lap-pressing element or member to press the lap W against the lower or bottom nipper 5 is depicted in FIGS. 3 and 4. However, these variants are conveniently provided with either an additional nipper 9, as shown in FIG. 1, or a relatively small rotatable lap-pressing cylinder or roll 13, as shown in FIG. 2.

Figure 5:
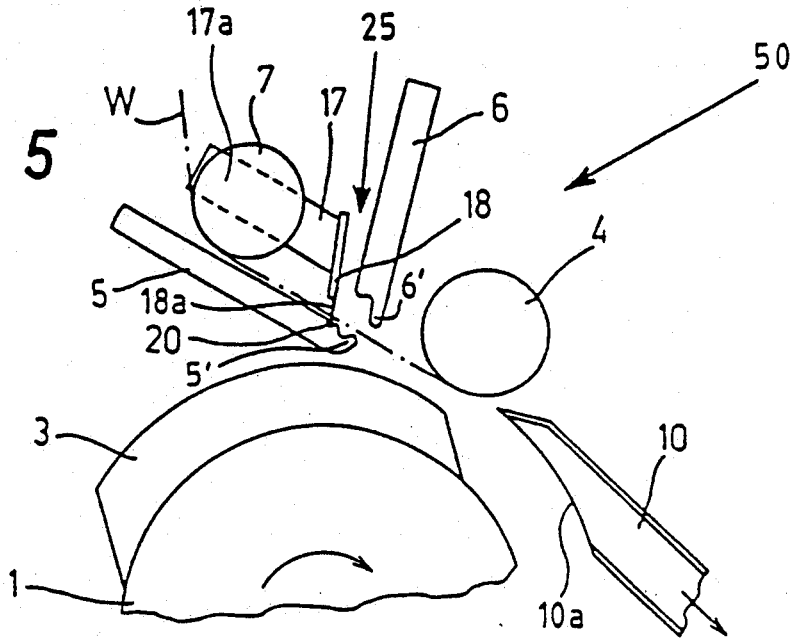
FIG. 5 shows a fragmentary side view, partially in section, of a fourth variant of a part of the combing machine depicted in FIG. 1.

On the other hand, in the fourth variant depicted in FIG. 5 the lap-pressing element or member is omitted. Instead, a top comb 18 having top comb needles or teeth **18*a* is disposed at movable supports 17 carried by the lower or bottom nipper 5 and movable relative thereto, such supports 17 being, for example, levers or lever members 17*a* which are pivotable about the axis of the intermittently rotatable feed cylinder or roll 7. In operation, the top comb 18 is kept lowered at the lower or bottom nipper 5 in the depicted position during fiber detachment, in order to comb out the trailing or rear ends of the fiber clusters detached from the lap W. The lower or bottom nipper 5 possesses immediately behind its front edge 5' a groove 20 which receives the free ends of the needles or teeth 18*a* of the top comb 18, so that the latter can extend fully through the lap W. However, while the lap W is being advanced by rotation of the intermittently rotatable feed cylinder or roll 7, the top comb 18 is lifted and thus disengaged from the lower or bottom nipper 5**.

Figure 6:
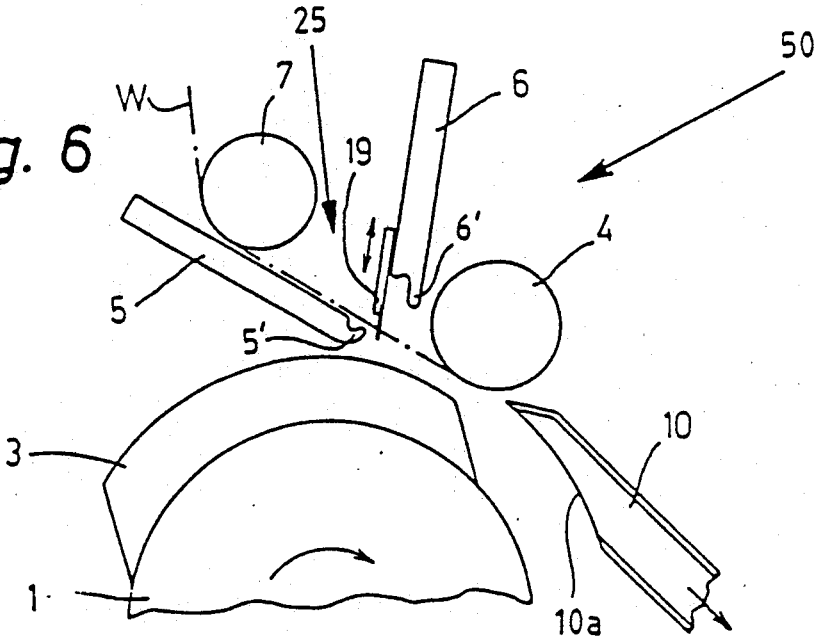
FIG. 6 shows a fragmentary side view, partially in section, of a fifth variant of a part of the combing machine depicted in FIG. 1.

When it is preferred to use a top comb 18 together with a lap-pressing element or member, it is possible to arrange, as shown in FIG. 6, a top comb 19 to be movable at the upper or top nipper 6. This top comb 19 is in the depicted lower position during fiber detachment in order to comb out the trailing or rear ends of the fiber clusters detached from the lap W. For the remainder of the time the top comb 19 is upwardly withdrawn relative to the upper or top nipper 6. The lap-pressing element or member is not shown in FIG. 6. However, either the additional nipper 9 of the variant in FIG. 1 or the relatively small lap-pressing cylinder or roll 13 depicted in FIG. 2 can be provided.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A combing machine, comprising:

a rotatable circular-comb cylinder having a predetermined axis of rotation;

a detaching pressure roll;

said rotatable circular-comb cylinder carrying at least one circular-comb segment and at least one detaching segment;

said at least one detaching segment cooperating with said detaching pressure roll in order to detach combed-out fibers of a lap to be combed;

a nipper unit comprising a lower nipper and an upper nipper;

said lower nipper being stationary relative to said predetermined axis of rotation of said rotatable circular-comb cylinder;

said upper nipper being movable relative to said lower nipper; and suction means for conveying by suction the combed-out fibers detached by said at least one detaching segment and said detaching pressure roll.

2. The combing machine as defined in claim 1, further including:

a top comb arranged between said lower nipper and said detaching pressure roll; and said top comb being insertable into the lap during the detachment of fibers from the lap being fed to said lower nipper.

3. The combing machine as defined in claim 1, further including:

an intermittently rotatable feed cylinder which is mounted at said lower nipper of said nipper unit;

lap-pressing means;

said lower nipper having a front edge;

said lap-pressing means serving to press the lap to be combed against said lower nipper at a predetermined location thereof; and said predetermined location at said lower nipper being positioned between said intermittently rotatable feed cylinder and said front edge of said lower nipper.

4. The combing machine as defined in claim 3, wherein:

said lap-pressing means constitutes an additional nipper which is movable relative to said lower nipper in order to clamp the lap to be combed against said lower nipper during the detachment of fibers from the lap being fed to said lower nipper.

5. The combing machine as defined in claim 3, further including:

drive means for rotating said intermittently rotatable feed cylinder prior to the detachment of fibers from the lap fed to said lower nipper.

6. The combing machine as defined in claim 3, further including:

drive means for rotating said intermittently rotatable feed cylinder subsequent to the detachment of fibers from the lap fed to said lower nipper.

7. The combing machine as defined in claim 3, further including:

drive means for rotating said intermittently rotatable feed cylinder prior to as well as subsequent to the detachment of fibers from the lap fed to said lower nipper.

8. The combing machine as defined in claim 3, wherein:

said lap-pressing means constitutes a rotatable lap-pressing cylinder.

9. The combing machine as defined in claim 8, further including:

drive means for rotating said lap-pressing cylinder; and free wheel means arranged in said drive means for rotating said lap-pressing cylinder.

10. The combing machine as defined in claim 1, wherein:

said suction means for conveying by suction the combed-out fibers comprises a suction shaft; and said suction shaft having an intake port which is adjacent to said detaching pressure roll for intaking by suction the combed-out and detached fibers.

11. The combing machine as defined in claim 1, wherein:

said suction means for conveying by suction the combed-out fibers comprises a screening drum having an interior space and defining a circumference;

said screening drum being located adjacent to said detaching pressure roll on a side remote from said nipping unit; and negative pressure source with which there is connected said interior space of said screening drum for conveying by suction said combed-out and detached fibers to said circumference of said screening drum and further conveying said combed-out and detached fibers on said circumference of said screening drum.

12. The combing machine as defined in claim 11, further including:

drive means for continuously rotating said screening drum.

13. The combing machine as defined in claim 11, further including:

drive means for intermittently rotating said screening drum.

14. The combing machine as defined in claim 11, further including:

drive means for rotating said screening drum with a pilgrim step motion.

15. The combing machine as defined in claim 11, wherein:

said screening drum possesses an air-pervious shell defining said circumference of said screening drum;

said screening drum comprising stationary air-impervious shielding means; and a predetermined part of said circumference defined by said air-pervious shell being internally covered by said stationary air-impervious shielding means.

16. The combing machine as defined in claim 11, further including:

a pair of pressing rollers;

the lap to be combed having a predetermined direction of travel; and said pair of pressing rollers being arranged downstream of said screening drum with respect to said predetermined direction of travel of the lap to be combed for receiving said combed-out fibers from said circumference of said screening drum.

17. The combing machine as defined in claim 16, wherein:

said lower nipper and said detaching pressure roll define therebetween a free space devoid of additional combing elements when said upper nipper is lifted away from said lower nipper.

18. The combing machine as defined in claim 16, further including:

a top comb arranged between said lower nipper and said detaching pressure roll; and said top comb being insertable into the lap during the detachment of fibers from the lap being fed to said lower nipper.

19. The combing machine as defined in claim 18, further including:

means for movably mounting said top comb at said lower nipper.

20. The combing machine as defined in claim 19, wherein:

said lower nipper is provided with a groove;

said top comb comprising top-comb needles having free ends; and said groove receiving said free ends of said top-comb needles during fiber detachment.

21. The combing machine as defined in claim 18, wherein:

said top comb is movably mounted at said upper nipper.

* * * * *